US005153560A

United States Patent [19]

Ichikawa

[11] Patent Number: 5,153,560

[45] Date of Patent: Oct. 6, 1992

[54] APPARATUS FOR DETECTING PRESENCE OF PERSON INSIDE ROOM HAVING DOOR

[75] Inventor: Masahiro Ichikawa, Ichikawa, Japan

[73] Assignee: Sumitomo Metal Mining Company, Limited, Japan

[21] Appl. No.: 752,099

[22] Filed: Aug. 29, 1991

[30] Foreign Application Priority Data

Sep. 7, 1990 [JP] Japan ..... 2-238632

[51] Int. Cl.[5] ..... G08B 19/00

[52] U.S. Cl. ..... 340/522; 340/521; 340/523; 340/541; 340/565

[58] Field of Search ..... 340/522, 521, 523, 541, 340/565, 825.31, 500, 544

[56] References Cited

U.S. PATENT DOCUMENTS 3,990,063 11/1976 Schuman ..... 340/544
4,195,286 3/1980 Galvin ..... 340/522
4,590,460 5/1986 Abbott et al. ..... 340/522
4,882,567 11/1989 Johnson ..... 340/522

FOREIGN PATENT DOCUMENTS 3300906 7/1984 Fed. Rep. of Germany ..... 340/544
3611184 9/1987 Fed. Rep. of Germany ..... 340/565
2527814 12/1983 France ..... 340/522

*Primary Examiner*—Jin F. Ng
*Assistant Examiner*—Dov Popovici
*Attorney, Agent, or Firm*—Wall and Roehrig

[57] ABSTRACT

An apparatus for detecting the presence of a person or persons inside a room having a door. The apparatus comprises a pyroelectric infrared sensor and a piezoelectric air pressure sensor. The infrared sensor detects movement of a person and produces a signal indicating the movement. The air pressure sensor detects opening and closing of the door and produces a signal indicating the opening and closing. A logic device including monostable multivibrators, AND gates, and an OR gate is connected between the outputs of the two sensors. When the signal indicating the movement is applied to the logic device later than the signal indicating the opening and closing, the logic device produces a signal indicating the entry of a person. When the signal indicating the opening and closing is applied to the logic device later than the signal indicating the movement, the logic device produces a signal indicating the exit of a person. These signals are processed by the logic device to know the presence or absence of a person.

6 Claims, 4 Drawing Sheets

APPARATUS FOR DETECTING PRESENCE OF PERSON INSIDE ROOM HAVING DOOR

FIELD OF THE INVENTION

The present invention relates to an apparatus for detecting the presence of a person or persons inside a room, the apparatus finding applications, for example, in prevention of crimes and energy saving as well as in automation of houses adapted for the aged and handicapped.

BACKGROUND OF THE INVENTION

One known apparatus for detecting every person inside a room processes images picked up by a camera such as a visible light camera or infrared camera. Another known apparatus used for the same purpose employs active sensors such as infrared sensors or ultrasonic sensors to detect a person within a narrow region. A further known apparatus makes use of a passive sensor equipped with a shutter mechanism.

In the prior art apparatus for detecting the presence of a person or persons with a camera, it is necessary to correct the processed image, depending on the condition of the camera. Also, it is not easy for the user to set up the apparatus. Furthermore, the apparatus is bulky. In addition, it consumes a large amount of electric power. Further, the optical system must be so set up that the dead angle is compensated for. Therefore, it is inevitable that the optical system is separate from the image processing portion. Moreover, the camera puts stress on the subject person. Hence, contrivance is needed in the field of house automation, especially in the way in which the optical system is received in the apparatus.

The person presence-detecting apparatus using an active sensor such as an infrared sensor or ultrasonic sensor constantly emits light, or keeps oscillating. Therefore, it consumes a large amount of electric power. Also, this apparatus is cable of covering only a limited narrow area, since restrictions are imposed on the positional relation between the emitting portion, or oscillating portion, and the light-receiving portion. In order to compensate for the dead angle, the sensor must be divided into plural separate portions which are separated from the signal-processing portion.

The apparatus comprising the passive sensor having the shutter mechanism has a portion that is invariably operating. Therefore, it is difficult to power this apparatus by a battery, and it is impossible to fabricate it as a unit.

SUMMARY OF THE INVENTION

Accordingly, it is an object of the present invention to provide an integrated apparatus which uses passive sensors each consuming only a small amount of electric power and which acts to detect the presence of a person or persons inside a room having a door.

It is another object of the invention to provide an apparatus which acts to detect the presence of a person or persons inside a room having a door and which has a novel circuit configuration including a sensor for detecting movement of the person as well as a sensor for detecting opening and closing of the door.

The above objects are achieved in accordance with the teachings of the invention by an apparatus in which a sensor detecting movement of a person is combined with a sensor detecting the opening and closing of a door, to detect the presence of the person inside a room.

In one feature of the invention, the sensor detecting the movement of the person is a pyroelectric infrared sensor. The sensor detecting the opening and closing of the door is a piezoelectric air pressure sensor. The pyroelectric infrared sensor utilizes a pyroelectric crystal whose spontaneous polarization varies with temperature. By making use of this phenomenon, infrared rays corresponding to the temperature of the human body and the ambient temperature, respectively, are made to hit the pyroelectric crystal. A change in the difference in energy between these two kinds of infrared rays brings about a change in the spontaneous polarization due to the pyroelectric effect. This, in turn, changes the surface charge on the electrode portion. A potential difference is obtained from this change. In this way, the movement of a person within the optical field of view is detected. The piezoelectric air pressure sensor comprises a piezoelectric material which is polarized when strain is applied to it. When atmospheric pressure changes, strain is produced in the piezoelectric material. As a result, the piezoelectric material is polarized, generating surface charge on the electrode portion. A potential difference is developed by the surface charge. Thus, the change in atmospheric pressure is detected.

One embodiment of the invention lies in an apparatus for detecting the presence of a person or persons inside a room having a door, said apparatus comprising: an infrared sensor which detects movement of a person inside the room and produces a signal indicating the movement of a person; an air pressure sensor detecting opening and closing of the door and producing a signal indicating the opening and closing of the door; an entry-detecting means which is connected with the two sensors and which, when the signal indicating the movement of a person is applied later than the signal indicating the opening and closing of the door, produces a signal indicating the entry of a person; an exit-detecting means which is connected with the two sensors and which, when the signal indicating the opening and closing of the door is applied later than the signal indicating the movement of a person, produces a signal indicating the exit of a person; a person presence-detecting means which is connected with the entry-detecting means and also with the exit-detecting means and which, when the signal indicating the entry of a person is applied, produces a signal indicating the presence of a person and which, when the signal indicating the exit of a person is applied, produces a signal indicating the absence of any person; and an inhibiting means which is connected between the infrared sensor and the person presence-detecting means and which, when the signal indicating the movement of a person is produced after the signal indicating the exit of a person is produced, inhibits the person presence-detecting means from producing the signal indicating the absence of any person.

The output signal from the piezoelectric air pressure sensor detecting the variation in the pressure caused by the opening and closing of the door is combined with the output signal from the pyroelectric infrared sensor detecting the movement of a person to detect movement of a person before and after the door is opened and closed. Consequently, it is possible to know whether a person enters or leaves the room. The obtained information is combined with the presence or absence of the output signal from the infrared sensor to know the presence of a person or persons inside the room. Preferably, the pyroelectric infrared sensor is a small sensor of the TO-5 type. Both pyroelectric sensor and piezoelectric air pressure sensor are passive sensors and so each sensor consumes only a small amount of electric power. Since the piezoelectric air pressure sensor itself has no directionality, it can be integrated with the pyroelectric infrared sensor. Furthermore, the pyroelectric infrared sensor has a wide field of view and exhibits a high sensitivity. Hence, few restrictions are imposed on the position at which the infrared sensor is mounted. This makes it easy to mount the infrared sensor. The output signals from these sensors are voltages signals and, therefore, it is easy to built the circuit. In addition, the apparatus can be powered by a battery, since it consumes only a small amount of electric power. In consequence, a small-sized integrated apparatus can be fabricated.

Other objects and features of the invention will appear in the course of the description thereof which follows.

DETAILED DESCRIPTION OF THE INVENTION

Figure 1:
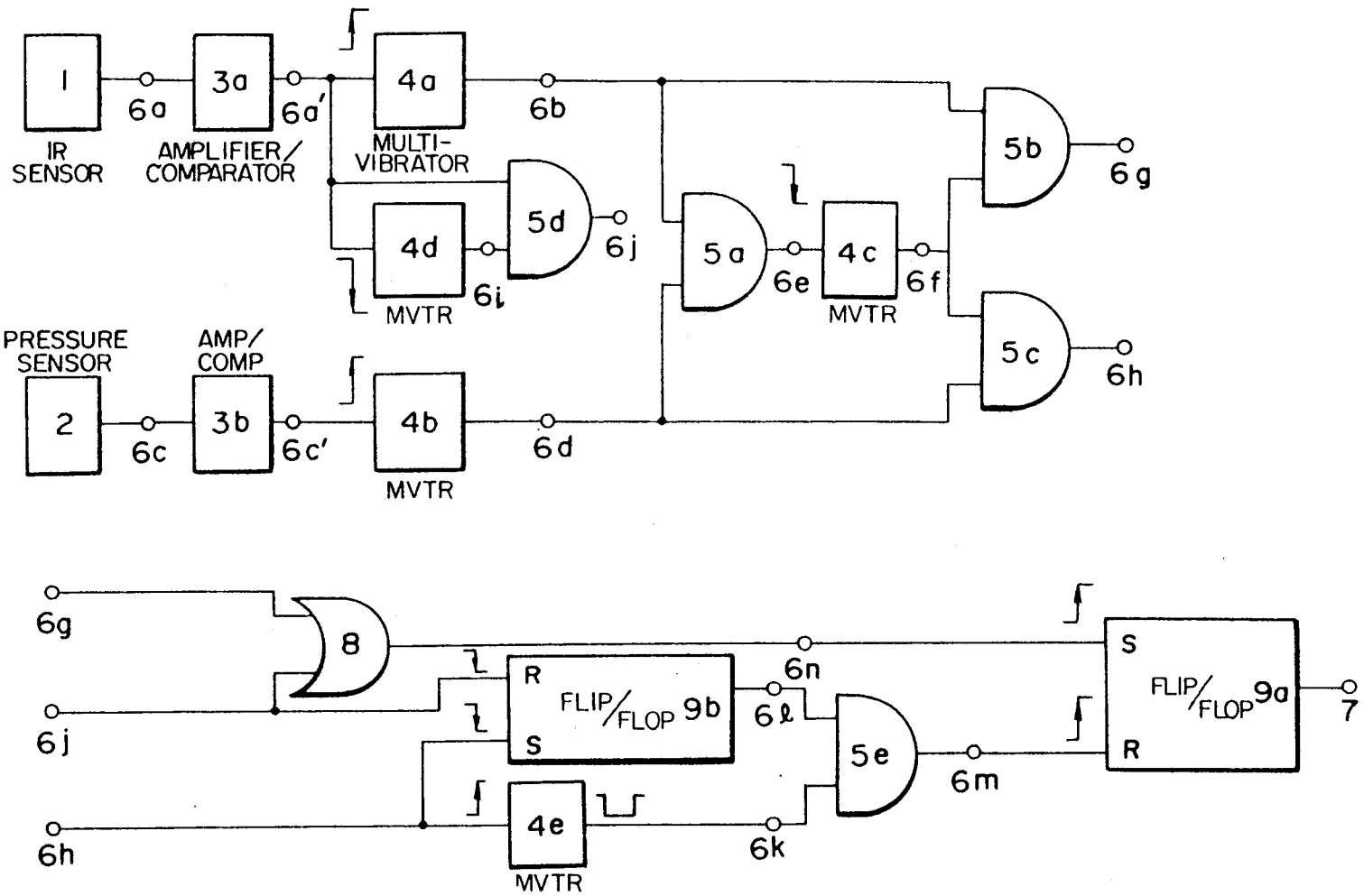
FIG. 1 is a circuit block diagram of an apparatus for detecting the presence of a person or persons inside a room having a door, the apparatus being built in accordance with the present invention.

Referring to FIG. 1, there is shown an apparatus according to the invention. This apparatus includes a pyroelectric infrared sensor 1. The output 6*a* of this sensor 1 is connected with a monostable multivibrator 4*a*, another monostable multivibrator 4*d*, and an AND gate 5*d* via an amplification-and-comparator circuit 3*a*. The apparatus further includes a piezoelectric air pressure sensor 2 whose output 6*c* is connected with a monostable multivibrator 4*b* via an amplification-and-comparator circuit 3*b*. The output 6*a'* of the amplification-and-comparator circuit 3*a* is directly connected with one input terminal of the AND gate 5*d*. Also, the output 6*a'* of the amplification-and-comparator circuit 3*a* is connected with the other input terminal of the AND gate 5*d* via the output 6*i* of the monostable multivibrator 4*d*. The gate 5*d* produces an output signal 6*j*. The output 6*b* of the multivibrator 4*a* and the output 6*d* of the multivibrator 4*b* are connected with an AND gate 5*a*.

The output 6*e* of the AND gate 5*a* is connected with a monostable multivibrator 4*c*. The output 6*f* of this multivibrator 4*c* is connected with one input terminal of an AND gate 5*b*, while the output 6*b* of the multivibrator 4*a* is connected with the other input terminal of the AND gate 5*b*. The output 6*f* of the multivibrator 4*c* is also connected with one input terminal of an AND gate 5*c*, the output 6*d* of the multivibrator 4*b* being connected with the other input terminal of the gate 5*c*.

The output 6*g* of the AND gate 5*b* and the output 6*j* of the AND gate 5*d* are connected with an OR gate 8. The output 6*j* of the AND gate 5*d* is connected with the reset terminal of a flip-flop 9*b*. The output 6*h* of the AND gate 5*c* is tied to the set terminal of the flip-flop 9*b*. The output 6*h* of the AND gate 5*c* is connected with a monostable multivibrator 4*e*. The output 6*k* of the multivibrator 4*e* and the output 6*l* of the flip-flop 9*b* are connected with two input terminals, respectively, of an AND gate 5*e*. The output 6*m* of the gate 5*e* is connected with the reset terminal of a flip-flop 9*a*. The output 6*n* of the OR gate 8 is connected with the set terminal of the flip-flop 9*a*. This circuit is powered by a lithium battery (not shown). Preferably, the battery is incorporated in the circuit.

Figure 2:
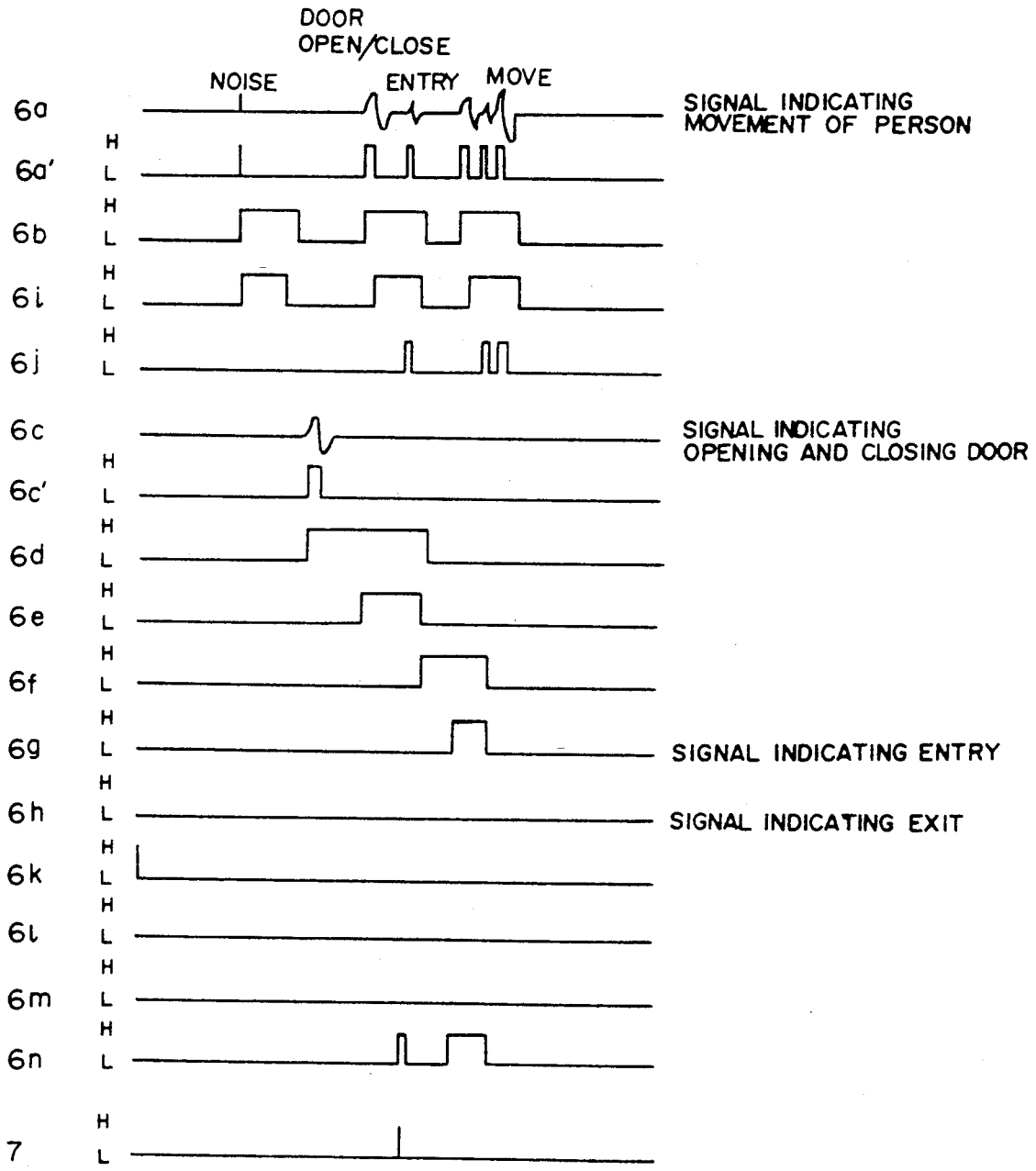
FIG. 2 is a timing chart of the waveforms of various signals produced in the apparatus shown in FIG. 1 when a person enters the room.
Figure 3:
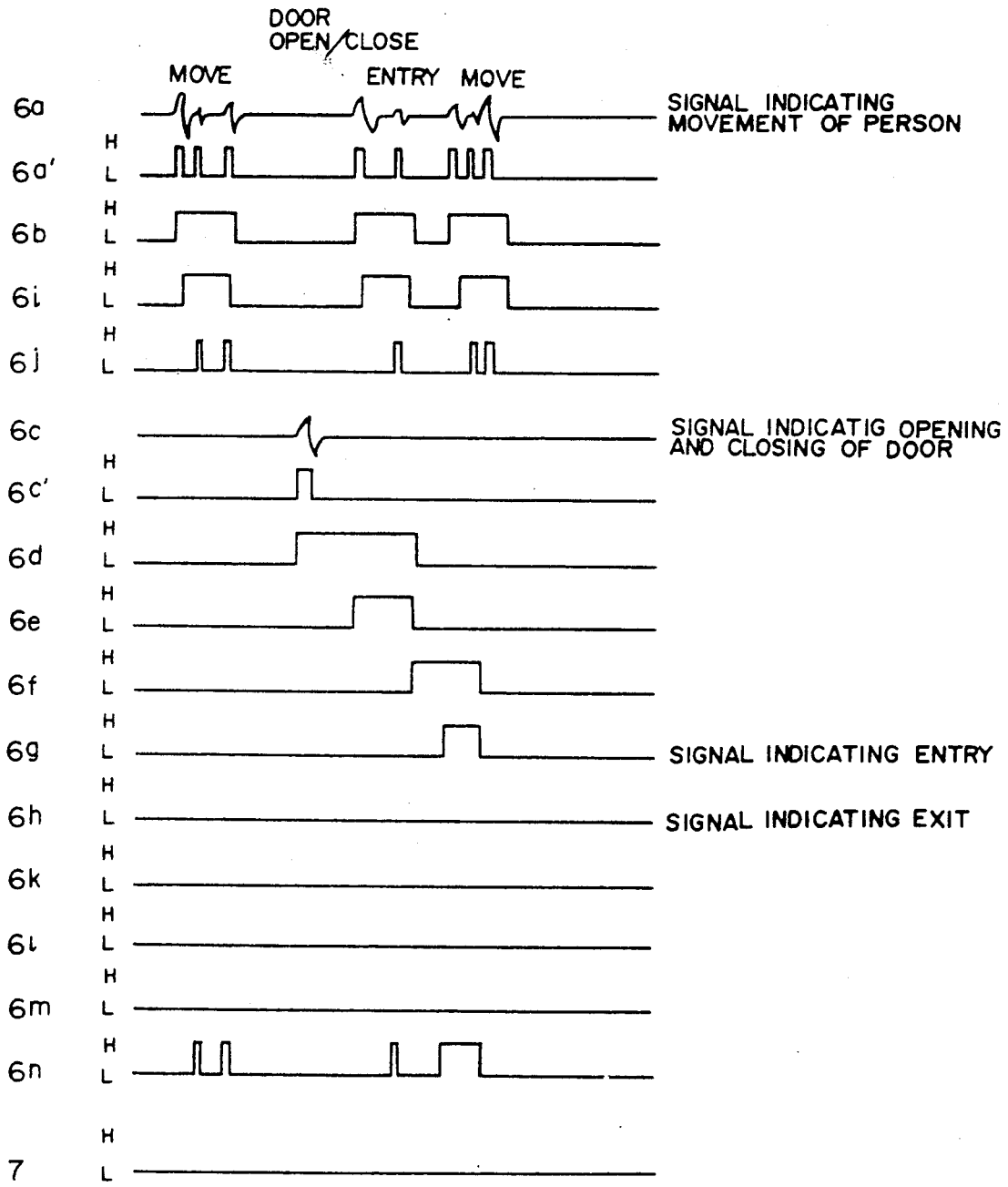
FIG. 3 is a timing chart of the waveforms of various signals produced in the apparatus shown in FIG. 1 when one person is present in the room and another person enters the room.
Figure 4:
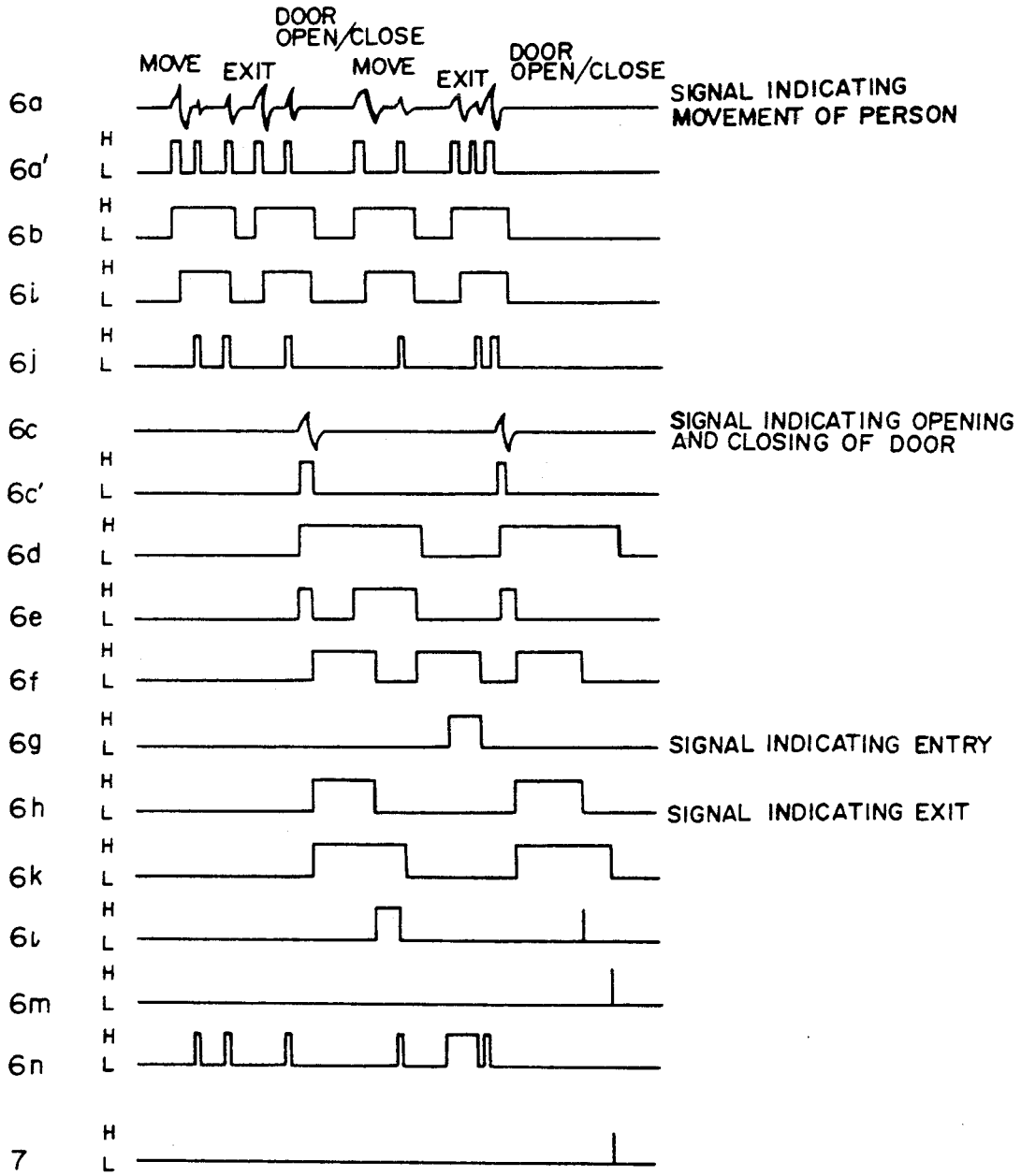
FIG. 4 is a timing chart of the waveforms of various signals produced in the apparatus shown in FIG. 1 when two persons successively leave the room.

The operation of this apparatus for detecting the presence of a person or persons is next described by referring also to FIGS. 2–4. Since the pyroelectric infrared sensor differentiates its input signal, the sensor detects only movement of a person or persons. Generally, where a person is present inside a room, it is hardly likely that he or she constantly moves about. Also, the parson moves at irregular intervals of time. We have noticed that whenever a person enters or leaves a room, he or she inevitably moves. The novel apparatus for detecting the presence of a person or persons detects the movement of a person made before and after the door is opened and closed to determine whether the person enters or leaves the room. Then, the apparatus judges that a person is located inside the room.

FIG. 2 is a timing chart of the waveforms of various signals produced by the novel apparatus when a person enters a room. At this time, the door is opened and closed. Then, the person moves inside the room. First, the piezoelectric air pressure sensor 2 shown in FIG. 1 detects the opening and closing of the door and produces output signal 6*c* indicating the opening and closing. This output signal 6*c* is applied to the amplification-and-comparator circuit 3*b*, which produces output signal 6*c'* of TTL level. The leading edge of the output signal 6*c'* triggers the monostable multivibrator 4*b*, so that the multivibrator produces output signal 6*d*. Subsequently, the pyroelectric infrared sensor 1 detects the movement of the person and delivers output signal 6*a* indicative of the movement. This output signal 6*a* is applied to the amplification-and-comparator circuit 3*a* to cause it to produce output signal 6*a'* of TTL level. This output signal 6*a'* triggers the monostable multivibrators 4*a* and 4*d* to produce output signals 6*b* and 6*i*, respectively. The output 6*i* from the multivibrator 4*d* and the output 6*a'* from the amplification-and-comparator 3*a* are applied to the two input terminals, respectively, of the AND gate 5*d*. When the pyroelectric infrared sensor 1 produces noise as shown in FIG. 2, i.e., when a single impulse is generated due to a malfunction, the output signal 6*j* of the AND gate 5*d* remains low, whereby the noise can be removed. If the person moves during the given width of the output signal 6*i* from the multivibrator 4*d*, then the output signal 6*j* from the AND gate 5*d* goes high. Thus, the movement of the person can be confirmed without being affected by the malfunction.

The output signal 6*b* from the monostable multivibrator 4*a* indicating the movement of a person and the output signal 6*d* from the monostable multivibrator 4*b* indicating the opening and closing of the door are applied to the AND gate 5*a*. When the output signal 6*b* of a given width and the output signal 6*d* of a certain width are overlapped, the AND gate 5a produces high output signal 6e. Hence, the movement of the person made before and after the door is opened and closed can be detected. The trailing edge of the output signal 6e triggers the monostable multivibrator 4c. The output signal 6f from this multivibrator 4c is applied to the AND gate 5b, together with the output signal 6b from the monostable multivibrator 4a. The output signal 6g from the AND gate 5b goes high only when the air pressure sensor output signal indicating the opening and closing of the door is detected earlier than the infrared sensor output signal indicating the movement of the person. Consequently, this output signal 6g indicates the entry of a person.

This output signal 6g and the output signal 6j from the AND gate 5d are applied to the OR gate 8. The output signal 6n from the OR gate 8 triggers the flip-flop 9a, so that the output signal 7 from this flip-flop goes high. This output signal 7 indicates that a person is present inside the room. When a person enters the room, the output signal 6g from the AND gate 5b can be used to create information given to the person.

FIG. 3 is a timing chart showing the waveforms of signals produced when one person is present inside a room and another person enters it. The output signal 7 from the flip-flop 9a which indicates the presence of a person remains high from the first. Since the person is present inside the room, the pyroelectric infrared sensor 1 detects the movement of the person. The output signal 6a from this sensor 1 triggers the monostable multivibrator 4d via the amplification-and-comparator 3a. The output signal 6i from this multivibrator 4d and the output signal 6a' from the amplification-and-comparator circuit 3a are applied to the AND gate 5d. The output signal 6j from the AND gate 5d goes high in response to the movement of the person without being affected by a malfunction. The high output signal 6j from the AND gate 5d is applied to the set terminal of the flip-flop 9a via the OR gate 8. Since the flip-flop 9a has been already set, the output signal 7 from the flip-flop 9a is kept high. This means that a person is present inside the room.

As shown in FIG. 3, if another person subsequently enters the room, a signal which sets the flip-flop 9a is applied to the flip-flop 9a from the output 6g of the AND gate 5b via the OR gate 8, in the same way as the operation described already in connection with FIG. 2. However, the flip-flop 9a has been already set as described above. Therefore, the output signal 7 from the flip-flop 9a is kept high.

FIG. 4 is a timing chart showing the waveforms of signals produced in the following situation: Two persons are present in the room as described above; one of them leaves the room; and the other leaves the room after a while. When one of them leaves the room, the pyroelectric infrared sensor 1 detects the movement of the person who is approaching the door. The sensor 1 produces the output signal 6a, which triggers the monostable multivibrator 4a via the amplification-and-comparator circuit 3a. Then, the door is opened. The piezoelectric air pressure sensor 2 detects the variation in the pressure and delivers the output signal 6c, which triggers the monostable multivibrator 4b via the amplification-and-comparator circuit 3b. As described previously, the output signal 6b from the multivibrator 4a and the output signal 6d from the multivibrator 4b are applied to the AND gate 5a and so the output signal 6e from this gate 5a responds to the movement of the person before and after the door is opened and closed. The trailing edge of the output signal 6e triggers the monostable multivibrator 4c. The output signal 6f from this multivibrator 4c and the output signal 6d from the monostable multivibrator 4b are applied to the AND gate 5c. The output signal 6h from this gate 5c goes high only when the output signal from the pyroelectric infrared sensor 1 indicating the movement of a person is detected earlier than the output signal from the piezoelectric air pressure sensor 2 that indicates the opening and closing of the door. It is possible to know from this high output signal 6h that a person has left the room.

The leading edge of the output signal 6h triggers the flip-flop 9b. When only one of the two persons present inside the room leaves it, it is possible that the remaining one moves intermittently. If such movement is made, it is detected by the infrared sensor 1. The output signal 6a from this sensor 1 is applied to the amplification-and-comparator circuit 3a. The output signal 6a' from this amplification-and-comparator circuit 3a causes the AND gate 5d to produce the output signal 6j as described above. The trailing edge of this output signal 6j resets the flip-flop 9b. Therefore, the output signal 6m from the AND gate 5e, or the signal applied to the reset terminal of the flip-flop 9a, is kept low, the gate 5e receiving the output signal 6l from the flip-flop 9b and the output signal 6k from the monostable multivibrator 4e. In consequence, the flip-flop 9a is not reset. Hence, the output signal 7 from the flip-flop 9a remains high. The output signal 6h from the AND gate 5c indicates that a person has left the room. On the other hand, the high output signal 7 from the flip-flop 9a indicates that a person still stays inside the room. That is, if movement of a second person is detected after a first person leaves the room, or within a given time set by the monostable multivibrator 4e, then the flip-flop 9a is stopped from being reset. This indicates that a person still remains.

If the last person remaining inside the room subsequently leaves it, the infrared sensor 1 detects movement of the person approaching the door and produces the output signal 6a as shown in FIG. 4. This output signal 6a triggers the multivibrator 4a via the amplification-and-comparator circuit 3a. Then, the door is opened. The air pressure sensor 2 detects the variation in the pressure and delivers the output signal 6c. This output signal 6c triggers the multivibrator 4b via the amplification-and-comparator circuit 3b. The output signal 6d from the multivibrator 4b and the output signal 6b from the multivibrator 4a are applied to the AND gate 5a. The trailing edge of the output signal 6e from this gate 5a triggers the multivibrator 4c. The output signal 6f from the multivibrator 4c and the output signal 6d from the multivibrator 4b are applied to the AND gate 5c. The output signal 6h from this gate 5c indicates that a person has left the room, as described already. The leading edge of this output signal 6h triggers the multivibrator 4e. The trailing edge of this output signal 6h sets the flip-flop 9b.

When no person remains inside the room, the infrared sensor 1 detects no movement of persons. The flip-flop 9b is not reset but remains set. That is, the output signal from the flip-flop 9b is kept high. When a given time elapses since the last person left the room, the output signal 6k from the monostable multivibrator 4e goes high. As a result, the output signal 6m from the AND gate 5e goes high, the gate 5e receiving the output signal 6l from the flip-flop 9b and the output signal 6k from the multivibrator 4e. This resets the flip-flop 9a. The output signal 7 from the flip-flop 9*a* goes low for the first time, indicating that no person remains inside the room.

Where two persons are present in the room, if they leave the room simultaneously rather than one after another, the infrared sensor 1 no longer detects movement of persons. Therefore, the flip-flop 9*b* is not reset. The flip-flip 9*a* is reset after a lapse of a given time which is set by the monostable multivibrator 4*e*.

Where two persons are present inside the room, if one of them leaves the room, and if the remaining one does not move until the given time set by the multivibrator 4*e* passes, then the infrared sensor produces no output signal. The flip-flop 9*a* is once reset. This indicates that no person is present in the room. If the remaining person moves subsequently, the movement is detected by the infrared sensor. The output signal 6*j* from the AND gate 5*d* is applied to the set terminal of the flip-flop 9*a* via the OR gate 8. The output signal from the flip-flop 9*a* goes high, indicating the presence of a person or persons inside the room, irrespective of whether the signal 6*g* indicating the entry and the signal 6*h* indicating the exit are present or not.

As described in detail thus far, the novel apparatus uses the piezoelectric air pressure sensor detecting variations in the pressure caused by the opening and closing of the door, as well as the pyroelectric infrared sensor detecting movement of a person. Thus, the movement of the person which is made before and after the door is opened and closed is detected. This enables ascertainment of the entry and exit of a person. This ascertainment is combined with the information obtained from the pyroelectric infrared sensor, i.e., the presence or absence of a person, to know whether at least one person is present inside the room. Preferably, the pyroelectric infrared sensor is a small infrared sensor of the TO-5 type. Both pyroelectric infrared sensor and piezoelectric sensor are passive sensors and, therefore, each sensor consumes only a small amount of electric power. Additionally, the piezoelectric air pressure sensor and the pyroelectric infrared sensor can be combined into a unit, because the piezoelectric air pressure sensor itself has no directionality. Since the pyroelectric infrared sensor has a wide field of view and shows a high sensitivity, the position at which the sensor is mounted can be varied over a wide region. This facilitates mounting the sensor. Furthermore, an arithmetic and logic unit can be easily fabricated, since the outputs from these two sensors are voltage signals. Further, the apparatus consumes only a small amount of electric power. This permits the apparatus to be powered by a battery. In this way, a small integrated apparatus can be built.

What is claimed is:

1. An apparatus for detecting a presence of a person inside a room having a door, said apparatus comprising:

an infrared sensor for detecting movement of a person and producing a signal indicating said movement;

an air pressure sensor for detecting opening and closing of the door and producing a signal indicating the opening and closing of the door;

entry-detecting means connected to said infrared and pressure sensors so that when the signal indicating the movement of a person is applied to said entry detecting means later than the signal indicating the opening and closing of the door, a signal indicating the entry of a person is produced;

exit-detecting means connected to said infrared and pressure sensors so that when the signal indicating the opening and closing of the door is applied to said exit detecting means later than the signal indicating the movement of a person, a signal indicating the exit of a person is produced;

a person presence-detecting means connected to said entry-detecting means and said exit-detecting means so that when a signal indicating the entry of a person is applied thereto, a signal indicating the presence of a person is produced and when a signal indicating the exit of a person is applied thereto, a signal indicating absence of any person is produced; and inhibiting means connected between said infrared sensor and the person presence-detecting means so that when a signal indicating the movement of a person is produced after the signal indicating the exit of a person is produced, the person presence-detecting means is inhibited from producing a signal indicating absence of any person.

2. An apparatus for detecting a presence of a person inside a room having a door as set forth in claim 1, further including a noise-removing means for removing noise produced by the infrared sensor.

3. An apparatus for detecting a presence of a person inside a room having a door as set forth in claim 2, wherein the output from the noise-removing means is applied to the inhibiting means.

4. An apparatus for detecting a presence of a person inside a room having a door as set forth in claim 1, wherein said inhibiting means is disabled after a predetermined time.

5. An apparatus for detecting a presence of a person inside a room having a door as set forth in claim 1, further including circuit means for causing the person presence-detecting means to produce the signal indicating the presence of a person, when the infrared sensor produces the signal indicating the movement of a person, irrespective of whether the signal indicating the entry and the signal indicating the exit are present or absent.

6. An apparatus for detecting a presence of a person inside a room having a door as set forth in claim 1, wherein the infrared sensor is a pyroelectric infrared sensor, and wherein the air pressure sensor is a piezoelectric air pressure sensor.

* * * * *